US008495769B1

(12) United States Patent
Lueck

(10) Patent No.: US 8,495,769 B1
(45) Date of Patent: Jul. 30, 2013

(54) URINETTE

(76) Inventor: Lowell Lueck, Bakersfield, CA (US)

( * ) Notice: Subject to any disclaimer, the term of this patent is extended or adjusted under 35 U.S.C. 154(b) by 375 days.

(21) Appl. No.: 13/087,422

(22) Filed: Apr. 15, 2011

Related U.S. Application Data

(60) Provisional application No. 61/419,843, filed on Dec. 5, 2010.

(51) Int. Cl.
*E03D 13/00* (2006.01)

(52) U.S. Cl.
USPC ..... 4/301; 4/307

(58) Field of Classification Search
USPC ..... 4/301, 307
See application file for complete search history.

(56) References Cited

U.S. PATENT DOCUMENTS 4,145,768 A 3/1979 Chevrette
4,180,875 A 1/1980 Wilson
4,490,863 A 1/1985 Pate
4,683,598 A 8/1987 Jones
4,982,455 A * 1/1991 Carter ..... 4/307
5,134,728 A * 8/1992 Sturm ..... 4/307
5,153,947 A 10/1992 Markels
5,390,374 A 2/1995 Hubrig
5,499,405 A 3/1996 Collins

* cited by examiner

*Primary Examiner* — Gregory Huson
*Assistant Examiner* — Christine Skubinna
(74) *Attorney, Agent, or Firm* — KBPTENTS; Luca D'Ottone

(57) ABSTRACT

The present invention discloses urinal that introduces a water use reduction method for flushing which supplies an accommodating solution for men and women as well. The water conserving urinal comprising an open-top funnel with a flexible hose thereon terminating in a rigid tube with a U-shaped gas trap section. In one of the embodiments of the present invention the apparatus is stored in the inside of a vanity cabinet. The instant application also discloses a completely new way to install the portable urinal in residential, and even commercial locations with the objective to conserve up to 12½ gallons of water per day per person.

6 Claims, 4 Drawing Sheets

URINETTE

CROSS REFERENCE TO RELATED APPLICATIONS

The present application claims priority from U.S. Provisional Patent Application No. 61/419,843 to Lowell Lueck filed on Dec. 5, 2010 directed to a URINETTE.

STATEMENT REGARDING FEDERALLY SPONSORED RESEARCH OR DEVELOPMENT

The activities that lead to the invention and reduction to practice of the device of the present application were not supported or sponsored in any way by federally related funds.

BACKGROUND OF THE INVENTION

1. Field of the Invention

The present invention relates to toilet devices, and more particularly to a small water-saving portable urinal for men, women, and children, that is designed to connect directly to the substructure plumbing drain line of the bathroom sink.

2. Brief Description of the Prior Art

Water-saving portable urinals are well known in the art. For example, U.S. Pat. No. 4,145,768 to Chevrette discloses and claims a water conserving urinal comprising an open-top funnel to be mounted on the wall with a flexible hose thereon terminating in a rigid tube with a U-shaped gas trap section. Under the teaching of Chevrette patent, the rigid tube trap extends into a sink drain pipe section adapted to be connected to the outlet of a sink drain trap, whereby liquids flow directly into the sewer line.

U.S. Pat. No. 4,490,863 to Pate discloses and claims a hand-held urine receiver that is constructed in the general form of a reservoir and is connected to a flexible hose. In Pate's patent, a flexible hose extends from the urine receiver and is connected to a drain line that forms a part of the plumbing network of a residential structure. In order to adapt the urine receiver of the present invention for female use, there is provided a vaginal insert.

U.S. Pat. No. 5,499,405 to Collins discloses and claims a urinal for capturing and directing urine into a drain line. The Collins inventive device includes an adjustable mounting structure securable to a wall surface within a bathroom. Under the teaching of Collins patent, a urinal is supported by the adjustable mounting structure and can be positioned at a desired height. The Collins device can be readily installed into existing bathroom structures to provide an alternative to a conventional toilet, thereby reducing flushing of the toilet and saving water.

U.S. Pat. No. 5,390,374 to Hubrig and Lachowitzer discloses and claims a water conserving urinal for male and female use attachable to a toilet. The Hubrig and Lachowitzer urinal includes a urinal bowl which is supported on a flexible member secured at its lower end to a pivot member. Water is supplied to the bowl from the toilet water supply line via a flexible supply line. According to Hubrig and Lachowitzer patent, a flush valve is provided in the water line and distributes a low volume of water around the interior of the bowl through an interiorly extending flush ring.

U.S. Pat. No. 5,153,947 to Markles discloses and claims a urinal assembly for attachment to a toilet of the type which is floor mounted over a drain, including a toilet-mounting flange. Under the teaching of Markles patent, preferably the urinal bowl is flushed and rinsed with a line which is connected to the toilet tank so that it is periodically rinsed. Also preferably, the urinal bowl swivels downwardly to provide height adjustment.

U.S. Pat. No. 4,683,598 to Jones discloses and claims a urinal for use by females which allows urination in a generally upright position and in a sanitary manner. Jones' invention comprises a flexible tube with a flared upper end shaped to conveniently fit around the vaginal area and collect urine which drains down the inside of the flexible tube to a collected bowl. The collecting bowl may be located on the floor or against the wall.

U.S. Pat. No. 4,180,875 to Wilson discloses and claims a urine disposal bypass unit includes a bowl for receiving urine having a bottom outlet for disposing of the urine, a one-way valve disposed in the outlet to permit flow from the bowl downward through the outlet and to prevent flow of gases upward into the bowl, a flush valve mounted on the bowl for supplying flushing liquid to a spray assembly mounted on the bowl at a position to supply the flushing liquid around the bowl to flush the bowl, a flexible drain hose coupled with the outlet of the bowl to provide communication between the bowl and a main drain, a flexible supply hose coupled with the flush valve to supply flushing liquid thereto, an extensible arm assembly mounted on a stationary support and carrying the bowl in order to permit the bowl to be extended from a storage position adjacent the stationary support and a check valve in the bowl base for passing urine and flushing liquid therethrough and maintaining a predetermined volume of liquid thereabove to act as a trap. According to Wilson's patent, the urine disposal bypass unit permits the flushing of urine while bypassing the toilet and requiring only one cup of flushing liquid.

Despite all the efforts listed above prior art patents describe structures that are either not truly convenient or else involve complicated, expensive, and overly difficult assembly and/or disassembly parts and procedures, and ultimately do not lead to the saving of a substantial amount of water. In the specific the urinal of the present application is stored completely out of sight when not in use thus constituting an obvious advantage for aesthetic reasons. In addition to that the drain tube used in the design of the device of the present invention is semi-rigid to facilitate a continual downward flow of urine when in use so as to allow for ease in complete evacuation of urine after each use. Finally the device of the present invention includes a mechanism for easier and equally efficient flushing of the urinal after each use. Other devices have been advertised on various media but never patented or described into a printed publication.

SUMMARY OF THE INVENTION

The object of the present invention is a small, convenient, portable urinal for everyone including but not limited to men, women, and children. What gives this invention its ornamental features is that it can be used by women and is designed to connect directly to the substructure plumbing drain of the bathroom sink.

It is then the principal object of the present invention to receive urine in a way that requires the use of a toilet only for solid waste, so as to contribute to water conservation efforts.

It is a secondary objective of the present invention to provide for an ornamental household article that is pleasant to see and display.

It is an additional objective of the present invention to provide a device that does not rust, or deteriorates in the humid high moist and hot conditions of a bathroom. It is a final objective of the present invention to provide for a device that is cheap to build, but that can eventually be sold at a premium.

These and other objective achieved by the device of the present invention will be apparent by the drawings, by their detailed description, and by the specification here from appended.

DESCRIPTION OF THE PREFERRED EMBODIMENT

The inventor commonly refers to the device of the present invention as the "Urinette". The device of the present invention is a small portable urinal for men, women, and even children.

Figure 1:
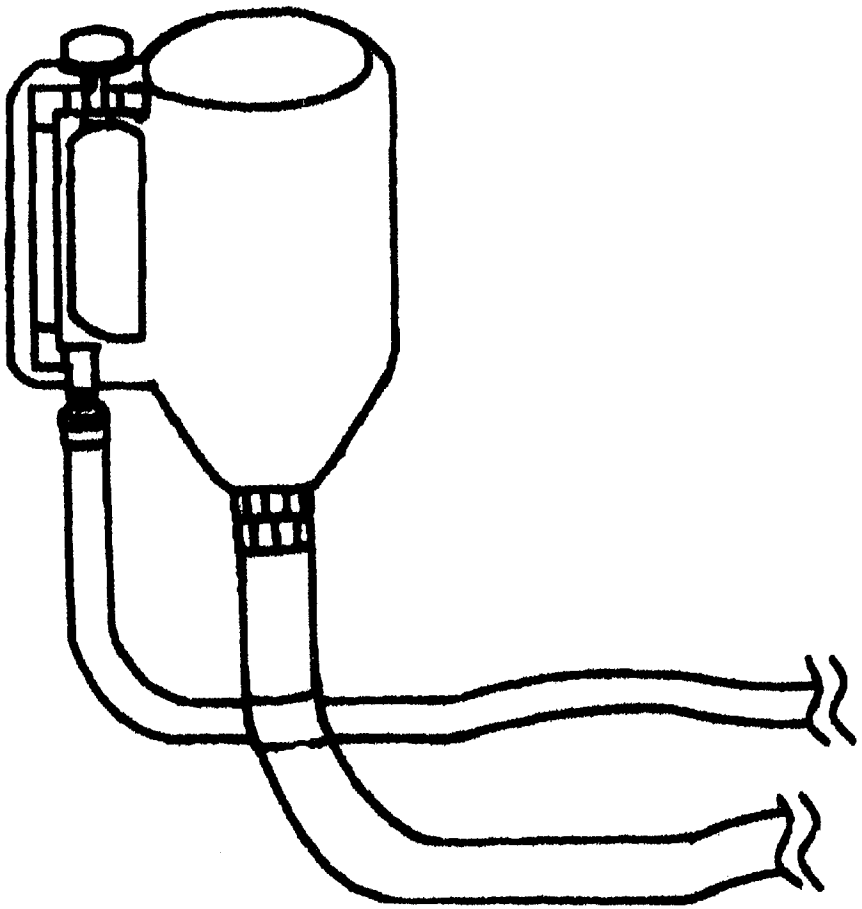
FIG. 1 is a detailed lateral side view of portable urinal in accordance with the teachings of the present invention.
Figure 2:
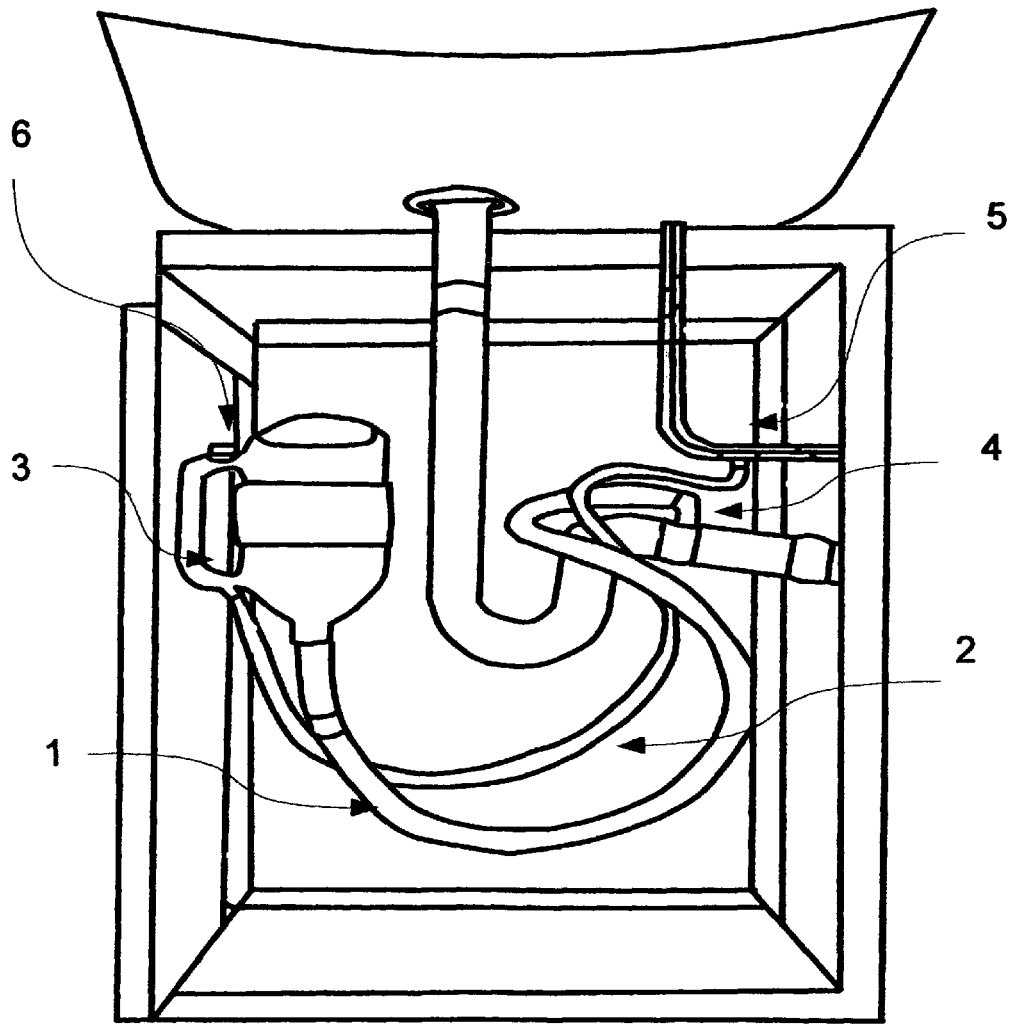
FIG. 2 is a lateral side view of portable urinal of FIG. 1 assembled to the drain hose of a bathroom sink and stored out-of-sight in the substructure of a vanity.
Figure 3:
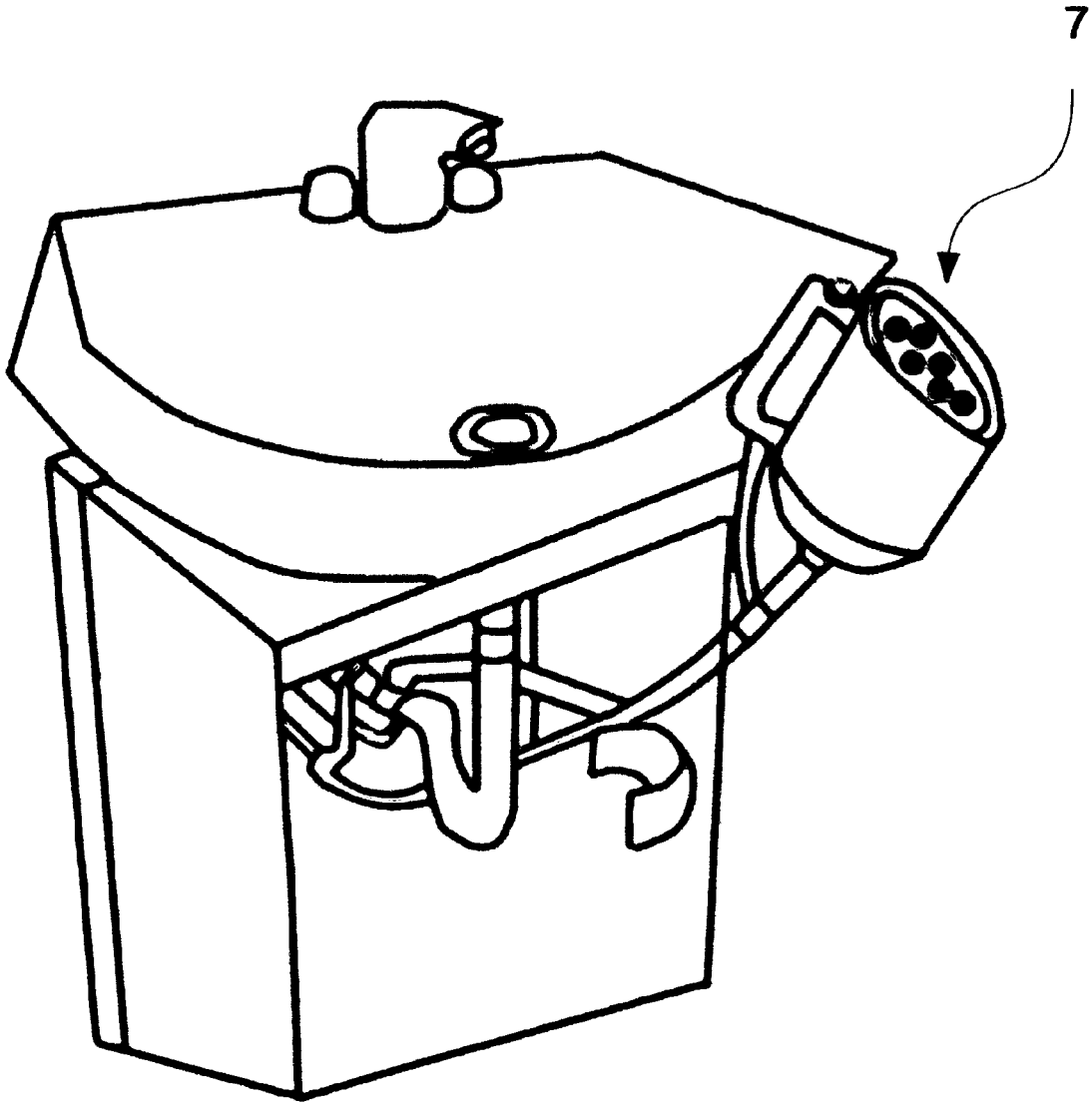
FIG. 3 is a perspective view of portable urinal of FIG. 1 assembled to the drain hose of a bathroom sink in its fully extended position outside the vanity cabinet.
Figure 4:
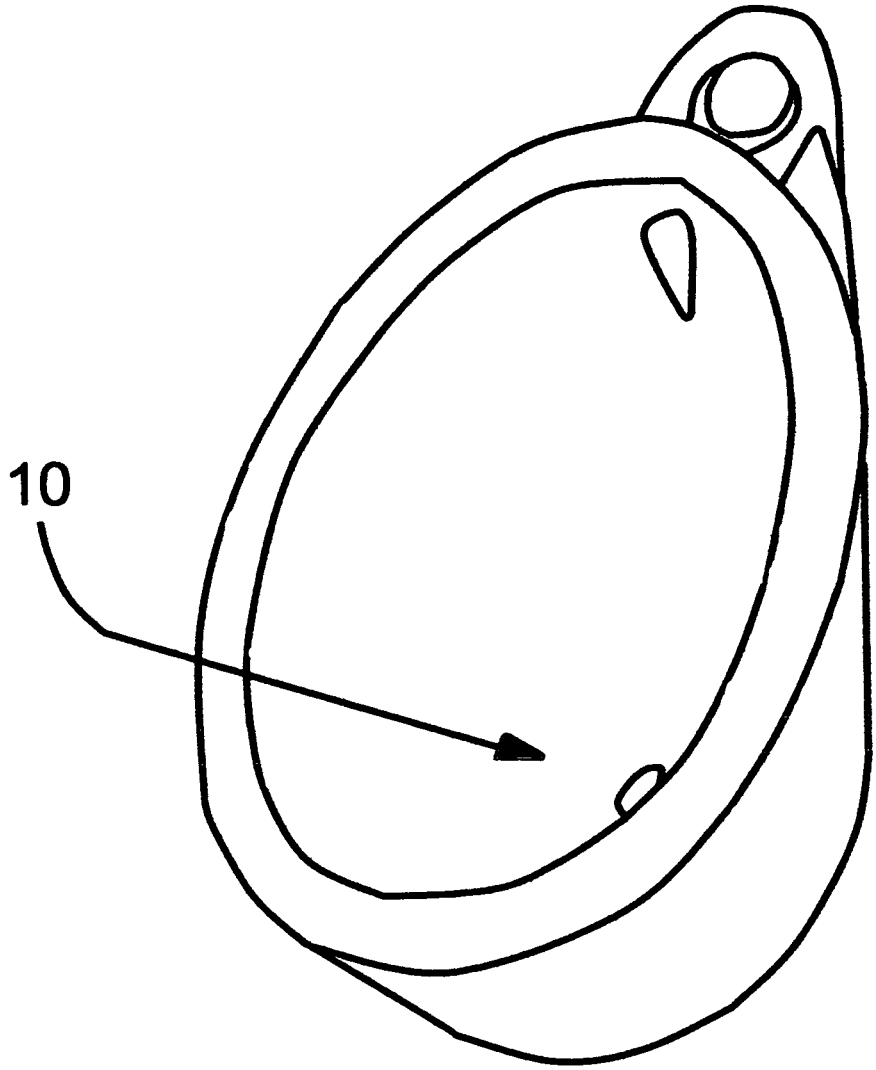
FIG. 4 is a detail of a second preferred embodiment the urine receiving cup of the portable urinal device of the present invention bringing in evidence the drain.

As it can be seen from the drawings the portable urinal device of the present invention have the following components: a flexible (flex) hose (1), a water supply hose (2), a urine receiving receptacle or cup (3) that has two sides: an internal side and an external side, a water tight connection between the house plumbing and the flexible hose (4), a water tight connection between said water supply hose and the house cold water main (5), a water control button (6), a plurality of water delivering holes (7) located in the internal side of said urine receiving receptacle or cup, a water tight connection between said urine receiving receptacle or cup and said flexible hose (8), a water tight connection between said water supply hose and said water control button (9), a water drain (10). In a second preferred embodiment of the present invention shown in FIG. 4 the plurality of water delivering holes is only one hole. More effective and efficient flushing of the Urinette would be accomplished be a plurality of "misting nozzles".

The "Urinette" is essentially a domestic urinal that is separate from the toilet plumbing currently utilized in most American homes. As currently designed, the urinal drains directly into the sink drain-pipe via a flex-hose. This flex-hose is sturdy enough to transport said waste from the urinal to the drain, but flexible enough to adjust to various heights. Moreover, a separate smaller hose engages the urinal from the cold water supply pipe. This allows the user to activate a flushing mechanism, which is fed by the cold water from the sink. The urinal is a rigid fiberglass, plastic, or stainless steel receptacle for receiving urine that adheres ergonomically between the pubic symphysis and the coccyx (perineum) but flexible enough to adjust to various heights" and bend in a manner to allow the urinal to be stored out of sight under the vanity when not in use. Considering the compact size of the urinal and the flexible hose, the "Urinette" can be stored out-of-sight, such as in the substructure of a vanity.

In the specific the method of using the urinette of the present invention consists of the steps of: opening the door of the vanity cabinet, extracting the urine receiving receptacle or cup, positioning said receptacle or cup in the appropriate position, releasing the flow of urine inside the internal surface of said urine receiving cup or receptacle, pushing said water control button to allow the water to flow over said internal surface of the urine receiving cup or receptacle, letting the water rise said internal surface, releasing the water control button, and returning receptacle to vanity cabinet for storage.

Materials for construction include but are not limited to durable rubber, plastic (tubing), stainless steel, fiberglass, or any other similar materials could be considered. In one of its preferred embodiments the portable urinal device of the present invention has said urine receiving cup or receptacle enlighted either by a white light, flashlight or light bulb that shines its light over the target where urine should be aimed at or by a neon light for aesthetic considerations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable urinal device consisting of:

(a) a flexible hose, (b) a water supply hose, (c) a urine receiving receptacle or cup that has two sides: an internal side and an external side, (d) a water tight connection between the house plumbing and the flexible hose, (e) a water tight connection between said water supply hose and the house cold water main, (f) a water control button, (g) a plurality of water delivering holes, (h) a water tight connection between said urine receiving receptacle or cup and said flexible hose, (i) a water tight connection between said water supply hose and said water control button, (j) a water drain.

2. The portable urinal device of claim 1 where said urine receiving cup or receptacle is enlighted.

3. The portable urinal device of claim 1 where said urine receiving cup or receptacle is enlighted by a phosphorescent neon lamp.

4. The portable urinal device of claim 1 where said urine receiving cup or receptacle is enlighted by a white light directed to the point where urine should be aimed by the user.

5. The portable urinal device of claim 1 where said water delivering holes are misting nozzles.

6. A method of using the portable urinal device of claim 1 consisting of the following steps:

(a) opening the door of the vanity cabinet, (b) extracting the urine receiving receptacle or cup, (c) positioning said receptacle or cup in the appropriate position, (d) releasing the flow of urine inside the internal surface of said urine receiving cup or receptacle, (e) pushing said water control button, (f) allow the water to flow over said internal surface of the urine receiving cup or receptacle, (g) letting the water rise said internal surface, (h) releasing the water control button (i) returning receptacle to vanity cabinet for storage.

* * * * *